US005491936A

United States Patent [19]

Logan et al.

[11] Patent Number: 5,491,936

[45] Date of Patent: Feb. 20, 1996

[54] PLASTIC WINDOW ASSEMBLY

[75] Inventors: Richard Logan, Kingsville, Canada; Charles E. Schiedegger, Metamora, Mich.; Michael C. Clark, Columbiaville, Mich.; Aundrea Nurenberg; Jeffery E. Schiedegger, both of Lapeer, Mich.

[73] Assignee: Mid-America Building Products Corporation, Plymouth, Mich.

[21] Appl. No.: 229,544

[22] Filed: Apr. 19, 1994

Related U.S. Application Data

[63] Continuation-in-part of Ser. No. 142,241, Oct. 26, 1993.

[51] Int. Cl.[6] ..... E06B 1/04

[52] U.S. Cl. ..... 52/105; 52/204.54; 52/204.61; 52/204.7; 52/208; 52/212

[58] Field of Search ..... 52/204.5, 204.53–204.57, 52/204.6, 204.61, 204.59, 204.7, 208, 211, 212, 171.1, 398, 745.15, 745.16, 105, 245

[56] References Cited

U.S. PATENT DOCUMENTS

| | | | |
|---|---|---|---|
| 283,093 | 8/1883 | Friedrick . | |
| 791,149 | 5/1905 | Hellyer | 52/245 X |
| 2,710,431 | 3/1951 | Griffon . | |
| 2,777,548 | 1/1957 | Adams | 52/204.53 |
| 3,226,903 | 12/1963 | Lillethun . | |
| 3,619,456 | 11/1971 | Taylor, Jr. . | |
| 3,951,294 | 4/1976 | Wilson | 52/245 X |
| 4,407,100 | 10/1983 | Huelsekopf | 52/212 |
| 4,495,739 | 1/1985 | Drennan . | |
| 4,525,961 | 7/1985 | Hansen . | |
| 4,563,846 | 1/1986 | Webb . | |
| 4,625,479 | 12/1986 | Giguere . | |
| 4,632,853 | 12/1986 | De Vrij . | |
| 4,780,998 | 11/1988 | Knapp . | |
| 4,858,402 | 8/1989 | Putz | 52/105 |
| 4,866,905 | 9/1989 | Bihy et al. | 52/105 X |
| 4,875,318 | 10/1989 | MacLeod et al. . | |
| 4,927,696 | 5/1990 | Berg | 52/105 X |
| 5,115,605 | 5/1992 | Butler . | |
| 5,133,168 | 7/1992 | Neilly et al. | 52/204.5 |
| 5,134,004 | 7/1992 | Moline . | |
| 5,168,682 | 12/1992 | Rye | 52/245 X |

*Primary Examiner*—Carl D. Friedman
*Assistant Examiner*—Robert J. Canfield
*Attorney, Agent, or Firm*—Barnes, Kisselle, Raisch, Choate, Whittemore & Hulbert

[57] ABSTRACT

An octagonal plastic window assembly is provided for mounting to an exterior surface of the building wall or doer. The window includes two spaced window panes, one of which is glass and the other plastic. An exterior trim ring is provided to circumscribe the window to give a finished appearance to the exterior of the window. An octagonal liner assembly is provided comprising a plurality of interconnected liner panels connected together by a snap fit and received within a rough opening in a building wall or door. An interior trim ring is provided for attachment to the liner assembly to give a finished appearance to the interior side of the building wall or door. The plastic window assembly can be installed without the use of fasteners.

16 Claims, 9 Drawing Sheets

22
28
32
92
86
90
86
21
31
30
88
86
INSIDE 92
86
88
96
96a 86
92
88
98
88
86
96
96a
98a 31
30
25
OUTSIDE
60
20
24
26

92
98
86
98a
88

PLASTIC WINDOW ASSEMBLY

This application is a continuation-in-part of application Ser. No. 08/142,241 filed Oct. 26, 1993.

FIELD OF THE INVENTION

This invention relates to window assemblies and more particularly to an octagonal plastic window assembly adapted to be mounted in a rough opening in a building wall and to provide a finished appearance to the rough opening.

BACKGROUND OF THE INVENTION

In a building construction, it is desirable to provide a window assembly that can be easily installed.

In conventional construction, a carpenter provides a rectangular frame in an opening and then fastens four pieces at each of the corners. A plurality of mitered pieces are then cut and assembled as an octagonal frame. Such a construction is difficult, time consuming and requires skilled workers making the window costly.

It has been desired to provide window assemblies of simpler configurations to facilitate installations. Thus, U.S. Pat. No. 4,563,846 discloses a window assembly mounted within a rough opening in a wall in a building where the window assembly comprises an integrally molded sill which defines an opening into which a unit of glazing material such as glass or plastic is inserted. After installation, wooden interior trim pieces are installed. In U.S. Pat. No. 4,780,998 a wooden window assembly includes a wood frame secured to a frame section into which a window panel unit and wood sash members are supported. U.S. Pat. No. 4,625,479 discloses a wood casing window which comprises a wooded sash, a multiple glazed sealed unit and a retaining device holding the glazed unit on the sash. U.S. Pat. No. 4,875,318 discloses a plastic building product including a louver or window which is integral therewith. A movable flange member is provided about the plastic body and is adjustably mounted thereon to accommodate siding of varying thicknesses.

Among the objectives of the present invention are to provide a plastic window assembly for an octagonal window which can be mounted in a rough opening in an exterior wall or door of a building to provide a finished appearance both on the exterior and the interior of a wall or door; where the window assembly can be assembled without the use of fasteners for convenient installation; wherein the window assembly can be readily changed to accommodate various thickness walls; wherein the window assembly includes spaced window panes, one of which is glass and the other plastic; and wherein the exterior and interior can be readily painted.

SUMMARY OF THE INVENTION

In accordance with the invention, a plastic window assembly comprises an outer assembly and an inner assembly. The outer assembly comprises a window and an exterior trim ring. The window includes a glass window pane and a plastic window pane spaced from one another. The glass window pane may be either clear or translucent. The plastic window pane may be either clear or translucent, and, alternatively, may be formed to simulate leaded glass or stained glass. The window is mounted on the exterior of an opening in the wall or door and the outer trim ring telescopes over the window to cover siding which abuts the window to give a finished look to the exterior of the building wall. The inner assembly comprises a liner assembly and an inner trim ring. The liner assembly is inserted through the opening from the interior of the wall and engages the window. The liner assembly is octagonally shaped and consists of a plurality of individual liner panels that are snapped together to form the octagonal liner. The interior trim ring is then mounted on the liner assembly to provide a finished appearance to the interior. The exposed portions of the interior and exterior trim rings and the liner assembly may be painted, stained or left natural.

The plastic window assembly of the present invention is advantageous in that it is easily assembled and installed, the parts may be interconnected without the use of fasteners, and thus can lie flat for easy and convenient shipping and/or storage.

Thus, the plastic window assembly of the present invention is provided for an octagonal window and is mounted within a rough opening in an exterior wall or door of a building. The plastic window assembly gives a finished appearance to both the interior and exterior of the wall or door and the parts of the window assembly can be conveniently assembled without the use of fasteners. Additionally, the plastic window assembly can be readily modified to accommodate walls of different thickness and includes spaded window panes, one of which is glass and the other being plastic. Furthermore, the exterior and the interior of the plastic window assembly can be readily painted.

DESCRIPTION OF THE PREFERRED EMBODIMENT

Figures 1, 2, 8D, 8E, 8F:
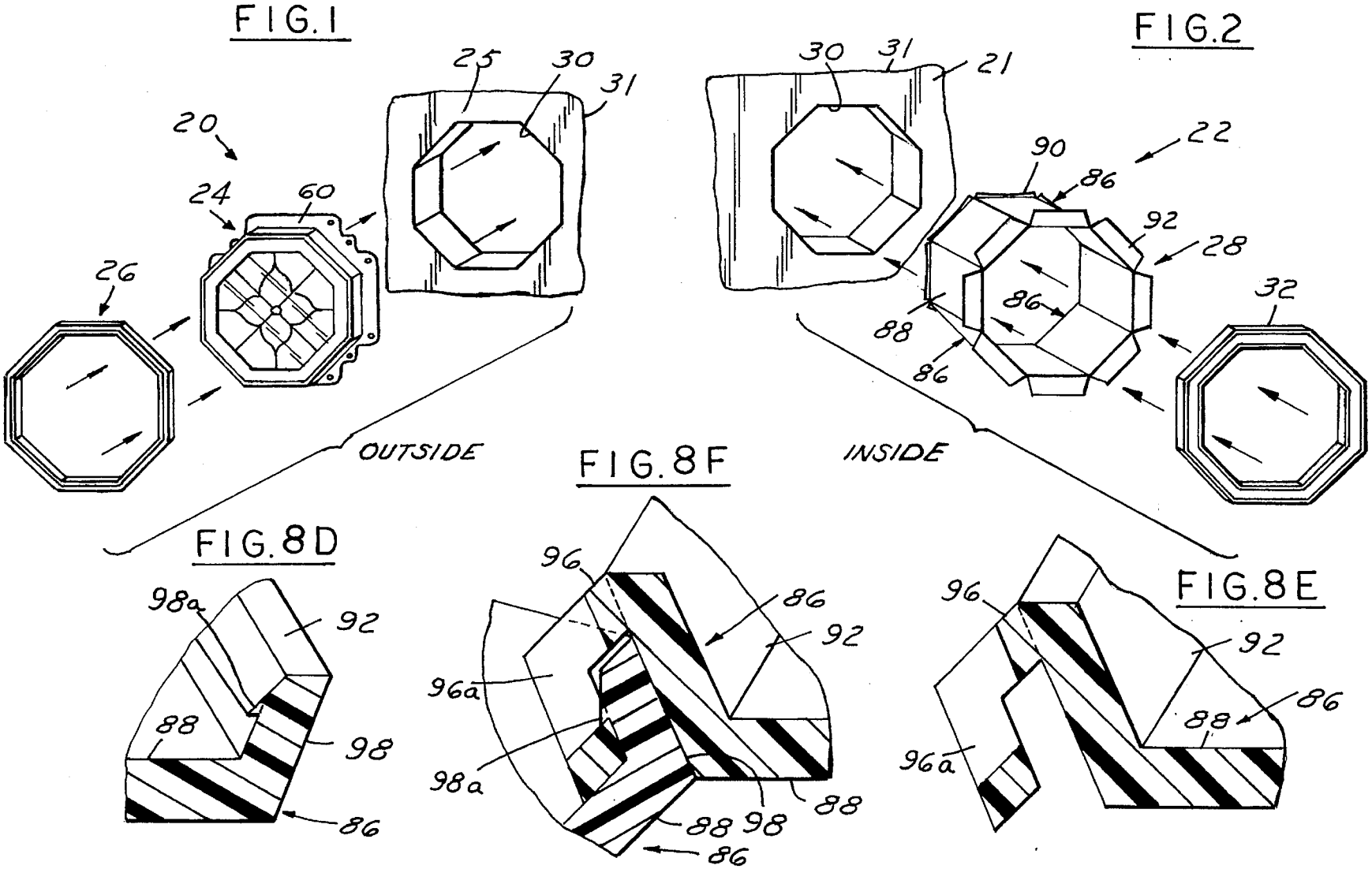
FIG. 1 is an exploded perspective view of the outside window assembly of the present invention.
FIG. 2 is an exploded perspective view of the inside window assembly of the present invention.
FIG. 8D is a view taken along line 8D—8D in FIG. 8A.
FIG. 8E is a view taken long line 8E—8E in FIG. 8A.
FIG. 8F is a partial sectional view of adjacent liner panels assembled by the parts shown in FIGS. 8D and 8E.

In accordance with the present invention, referring to FIGS. 1 and 2, it can be seen that the plastic window assembly of the present invention comprises an outside assembly 20 and an inside assembly 22. The outside assembly 20 is adapted to be mounted to an exterior surface 25 of a building wall or door 31 and the inner assembly 22 is adapted to be mounted within a rough opening 30 therein. The outside assembly 20 comprises a window 24 and an exterior trim ring 26. The interior assembly 22 comprises a liner assembly 28 and an interior trim ring 32.

Figure 3:
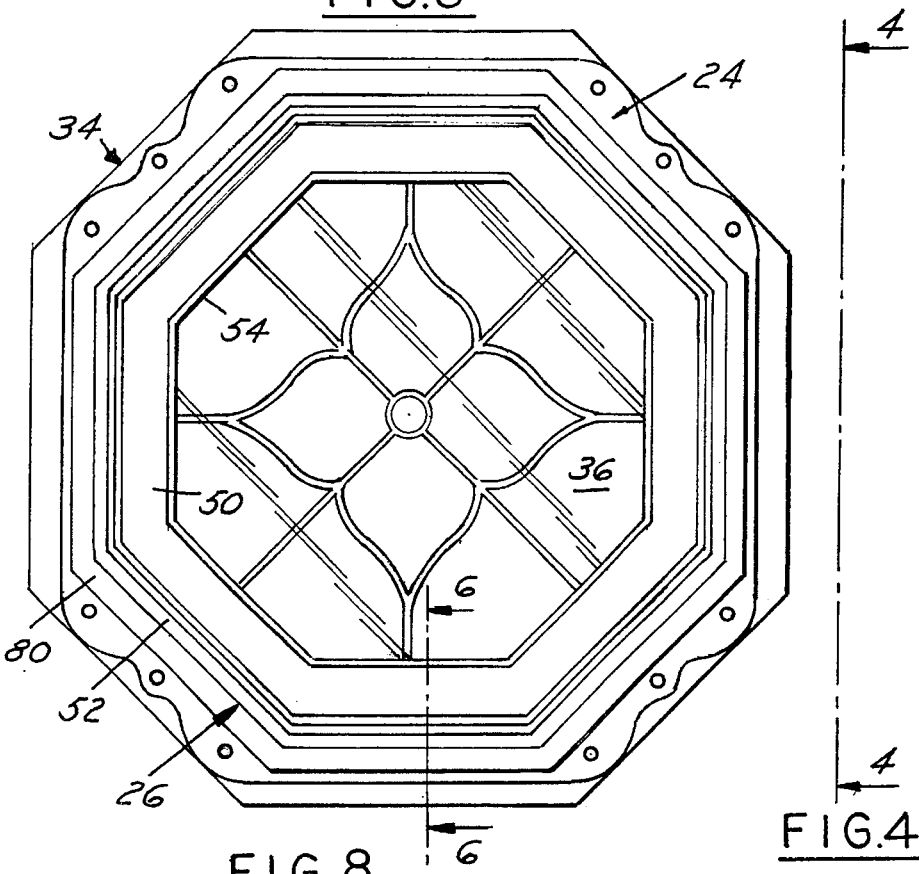
FIG. 3 is a plan view of the plastic window assembly of the present intention.
Figure 4:
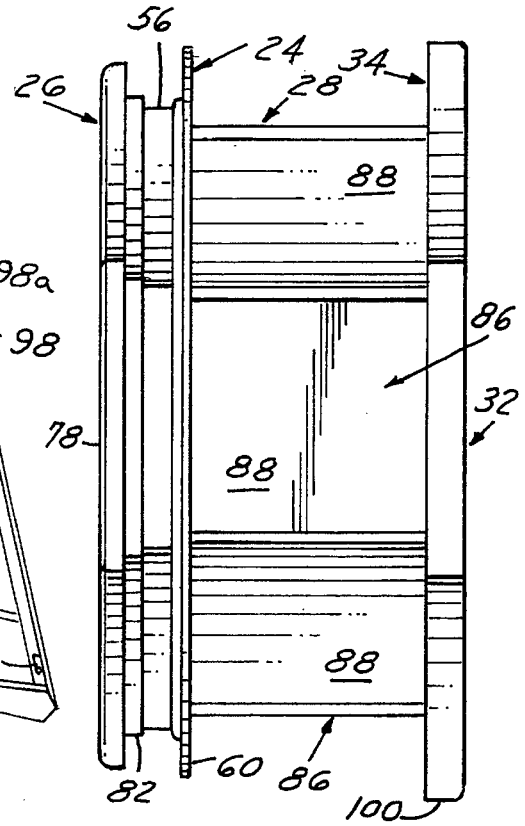
FIG. 4 is a view taken generally along line 4—4 in FIG. 3.
Figure 5:
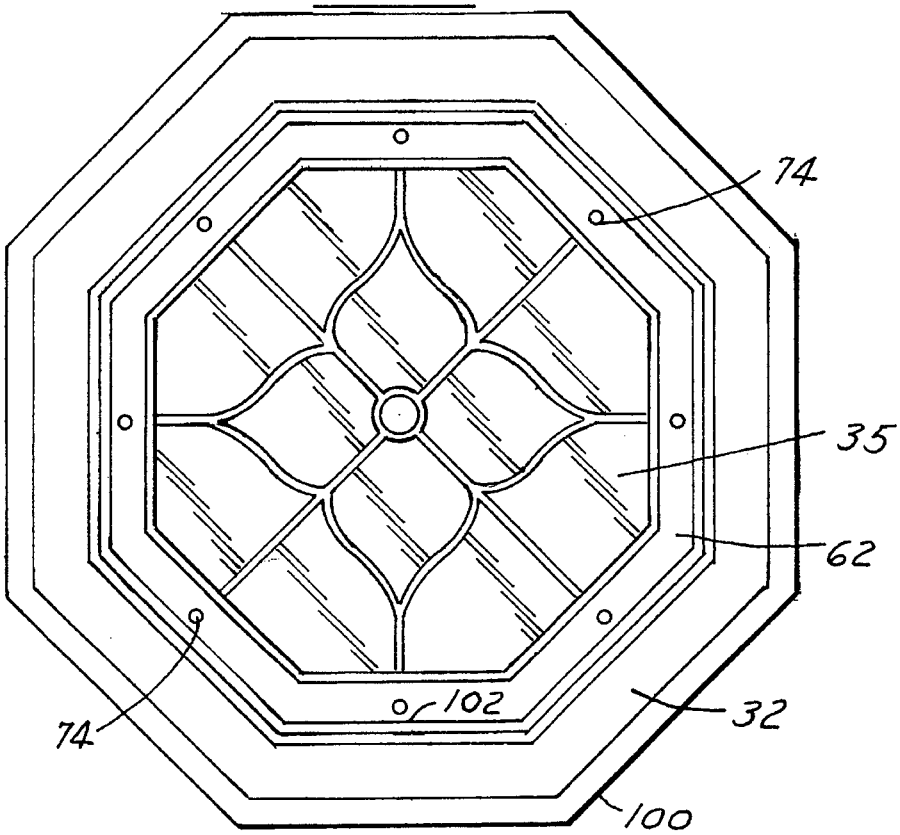
FIG. 5 is a back view of the plastic window assembly of the present invention.

The plastic window assembly is preferably delivered to the job site unassembled (FIGS. 3–5) and can be easily assembled as shown in FIGS. 1 and 2.

Figure 6:
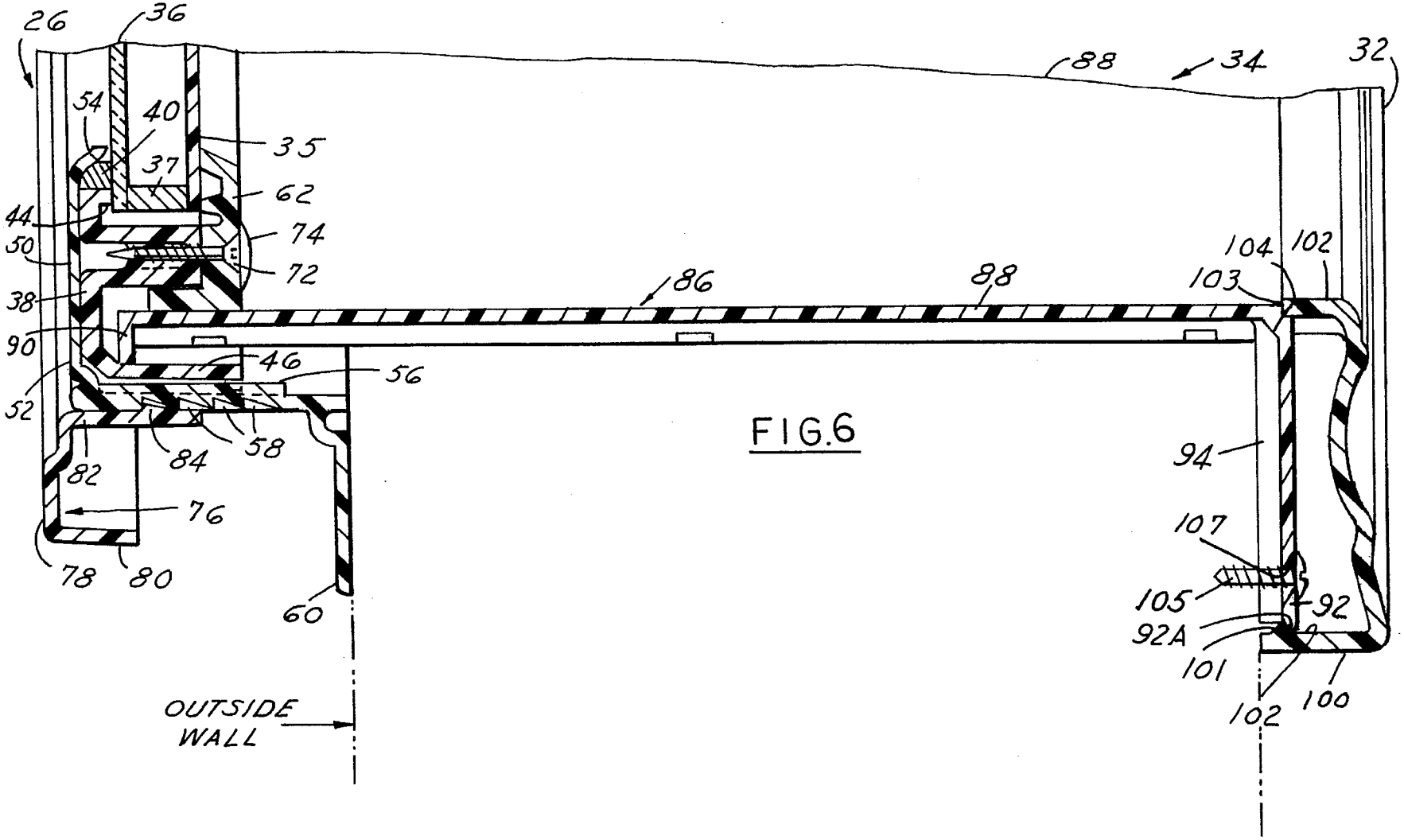
FIG. 6 is a partial sectional view taken generally along line 6—6 in FIG. 3.

A fragmentary cross section of the plastic window assembly is shown in FIG. 6 where it can be seen that the window 24 comprises an annular plastic retainer 38, an annular plastic housing 50, and an annular plastic clamp ring 62. One of the window panes 35 is plastic and, if desired, may be formed to simulate clear or stained leaded glass. The other window pane 36 is glass and may be either clear or translucent. The window panes 35,36 are kept in spaced relation by a sealant strip 37 and are held between the retainer 38 and the clamp ring 62.

Figure 9:
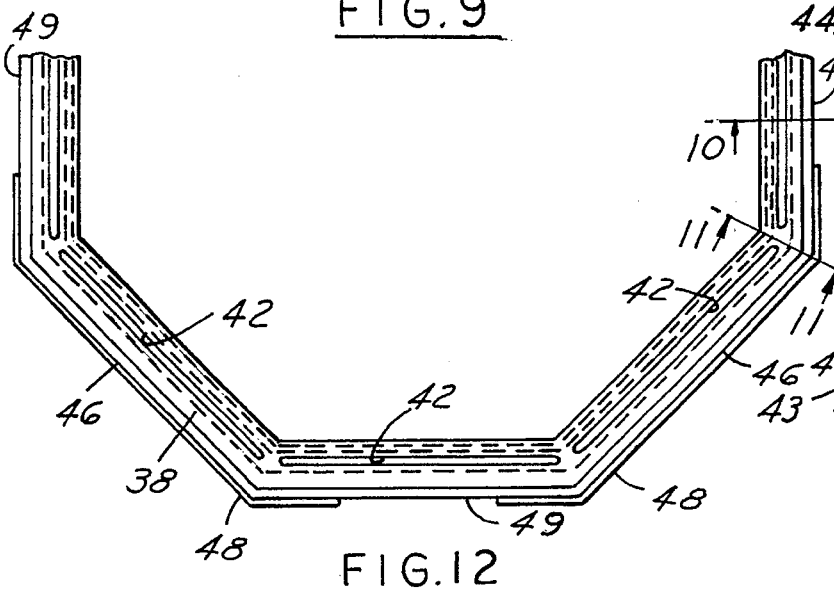
FIG. 9 is a partial plan view of the window retainer.
Figure 10:
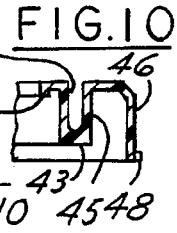
FIG. 10 is a sectional view taken generally along line 10—10 in FIG. 9.
Figure 11:
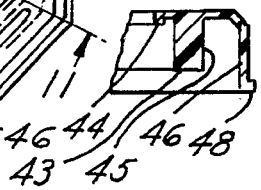
FIG. 11 is a sectional view taken generally along line 11—11 in FIG. 9.

The retainer 38 (FIGS. 9–11) has a hollow central wall portion 42, an inner annular peripheral lip 44 that abuts the window pane 36, an outer peripheral wall 46, and a radial annular lip 48 seen in FIGS. 10 and 11. The radial lip 48 is interrupted to define gaps 49 about the periphery thereof.

Figure 12:
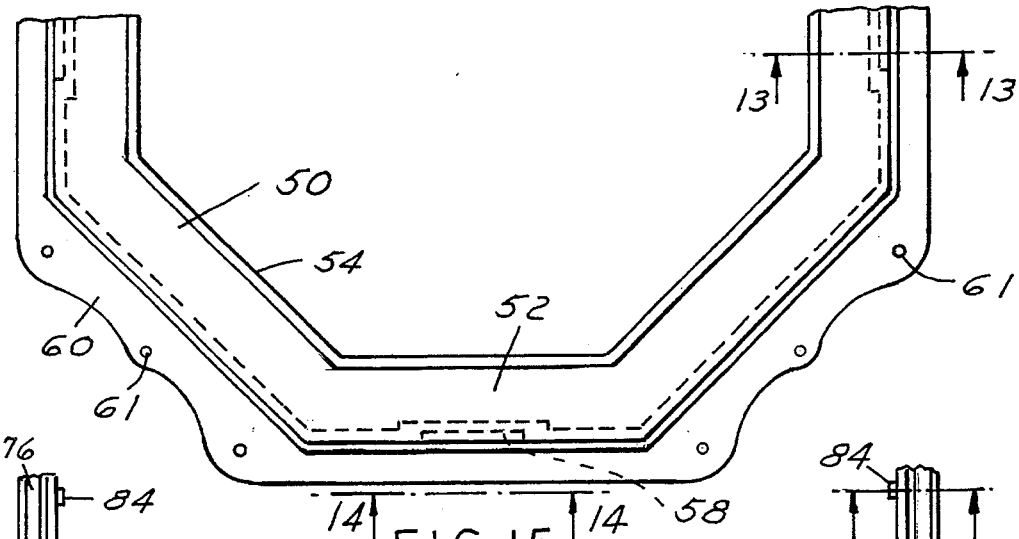
FIG. 12 is a partial plan view of the window housing.
Figure 13:
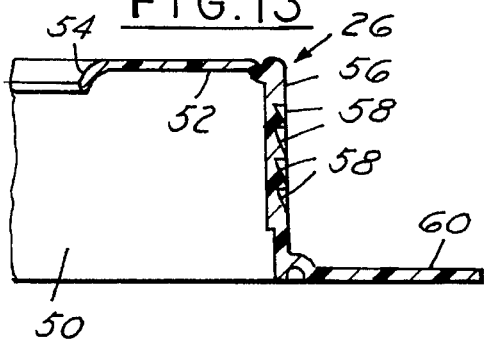
FIG. 13 is a sectional view taken generally line 13—13 in FIG. 12.
Figure 14:
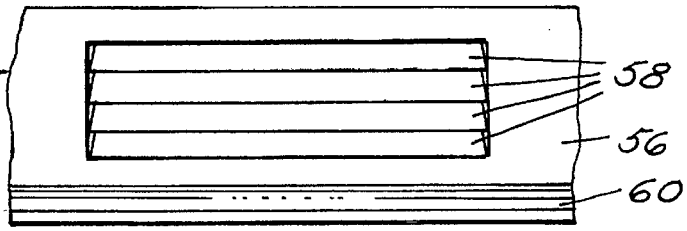
FIG. 14 is a view taken generally along line 14—14 in FIG. 12.
Figure 20:
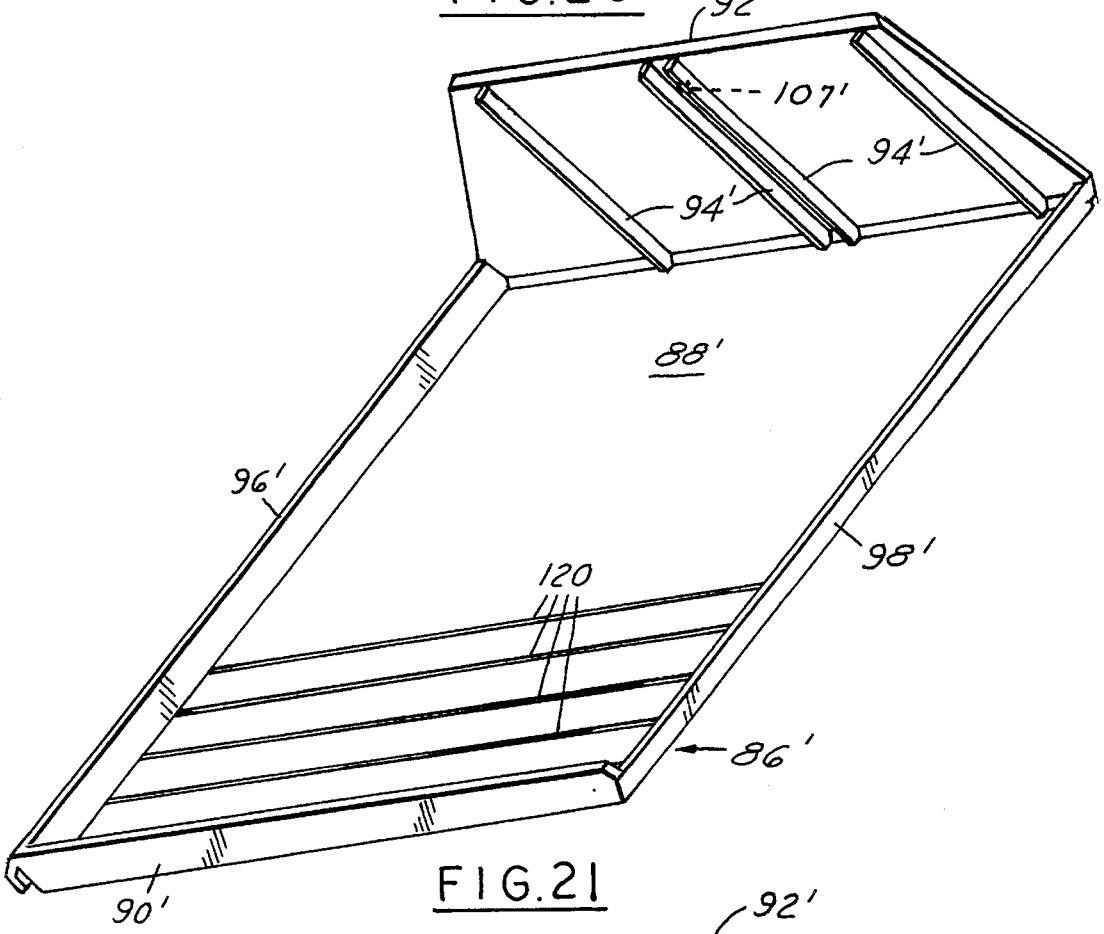
FIG. 20 is a perspective view of a modified form of liner panel.
Figure 21:
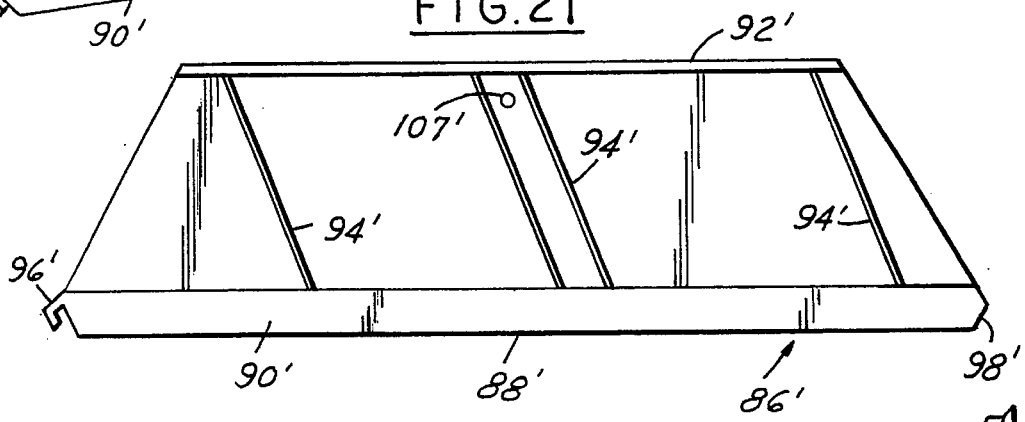
FIG. 21 is an end view taken from the lower end of FIG. 20.
Figure 22:
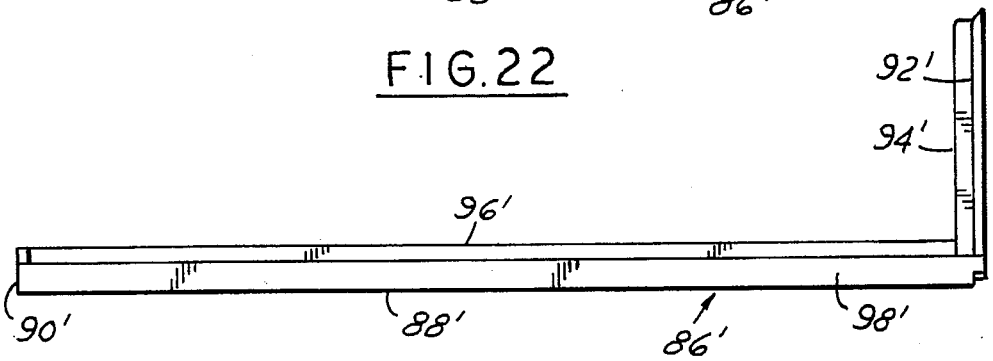
FIG. 22 is a side elevational view.

The housing 50 (FIGS. 12–14) comprises an outer wall 52 having a curved inner annular peripheral lip 54, a radial wall 56 having diametrically opposed sets of serrations 58, and a peripheral flange 60 as seen in FIG. 13. The flange 60 on housing 50 has holes 61 for fasteners so that the window 24 can be conveniently secured to the external surface 25 of the wall or door 31. The retainer 38 is secured to the housing 50 by ultrasonic welding.

Figure 19:
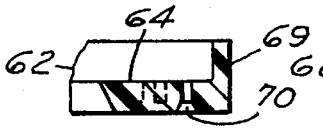
FIG. 19 is a view taken generally along line 19—19 in FIG. 17.
Figure 18:
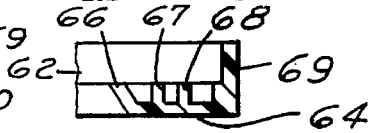
FIG. 18 is a view taken generally along line 18—18 in FIG. 17.

The clamp ring 62 (FIGS. 6 and 17–19) abuts the window pane 35 to secure both window panes in the window 24. The clamp ring 62 as seen in FIGS. 18 and 19 has a support wall 64, and an inner peripheral wall 66 that extends radially inwardly. A first axially extending abutment wall 67 abuts the window panel 35. A second axially extending abutment wall 68 and an outer wall 69 of the clamp ring 62 are provided for engaging the bottom and side surfaces 43,45 of the hollow central wall 42 of the retainer 38. The clamp ring 62 is securely fastened to the retainer 38 by fasteners 72 that extend through holes 70 in the clamp ring 62. End caps 74 are provided to cover the fastener 72. A caulking strip 40 is provided and is held by the curved inner peripheral lip 54 of the housing 50.

Figure 15:
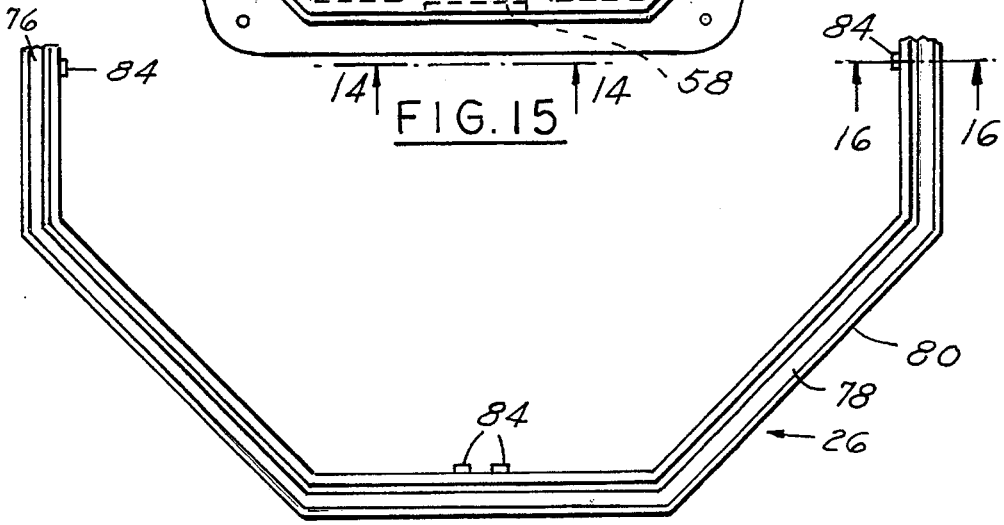
FIG. 15 is a partial plan view of the exterior trim ring.
Figure 16:
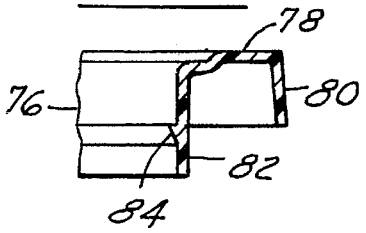
FIG. 16 is a view taken generally along line 16—16 in FIG. 15.
Figure 17:
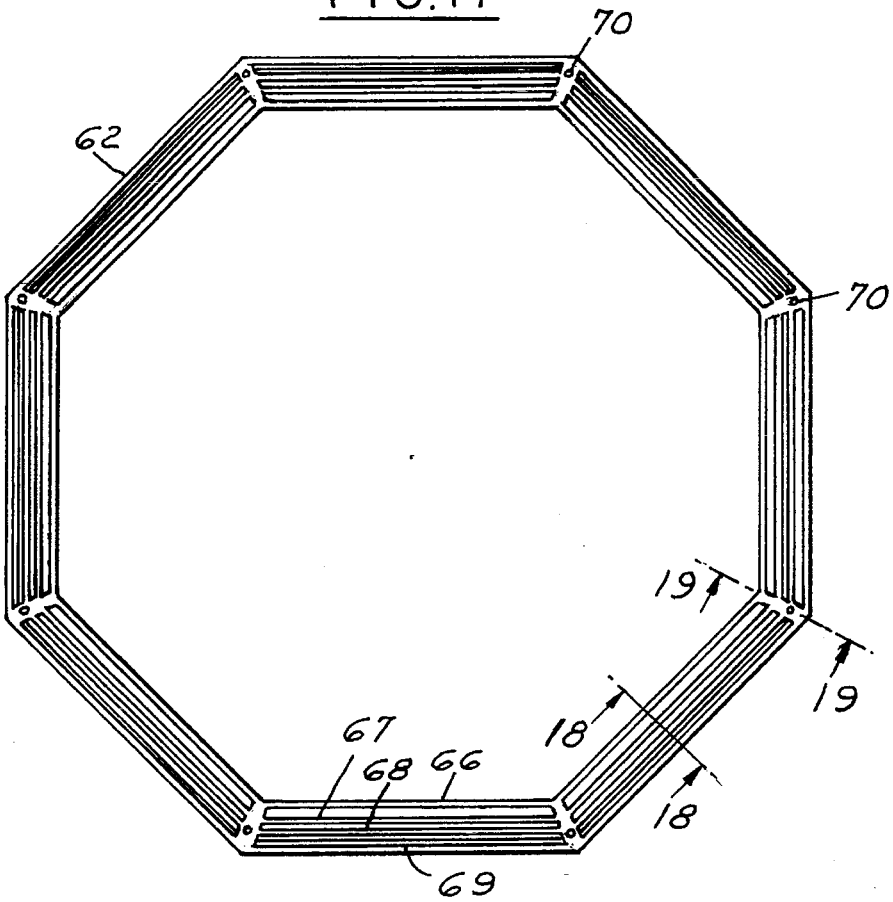
FIG. 17 is a plan view of a clamp ring.

An annular exterior trim ring 26 (FIGS. 15 and 16) is provided for telescopic engagement with the housing 50 to give a finished appearance to the exterior side 25 of the wall or door 31. Trim ring 26 as seen in FIG. 16 has a front wall 78, an outer radial wall 80 and an inner radial wall 82 forming an internal configuration corresponding to the external configuration of the housing 50. As shown in FIG. 6, the inner radial wall 82 of trim ring 26 telescopes over radial wall 56 of the housing 50. The radial wall 82 has diametrically opposed sets of teeth 84 (FIG. 15). Preferably, there are four sets of teeth 84 corresponding to an equal number of sets of serrations 58 on the radial wall 56 of housing 50. The serrations 58 and teeth 84 are complementary such that when trim ring 26 is telescoped over the housing 50 and moved axially, teeth 84 selectively engage serrations 58 until the trim ring 76 abuts the siding. Thus, it can be seen that siding of various axial thickness can be accommodated.

Figure 8:
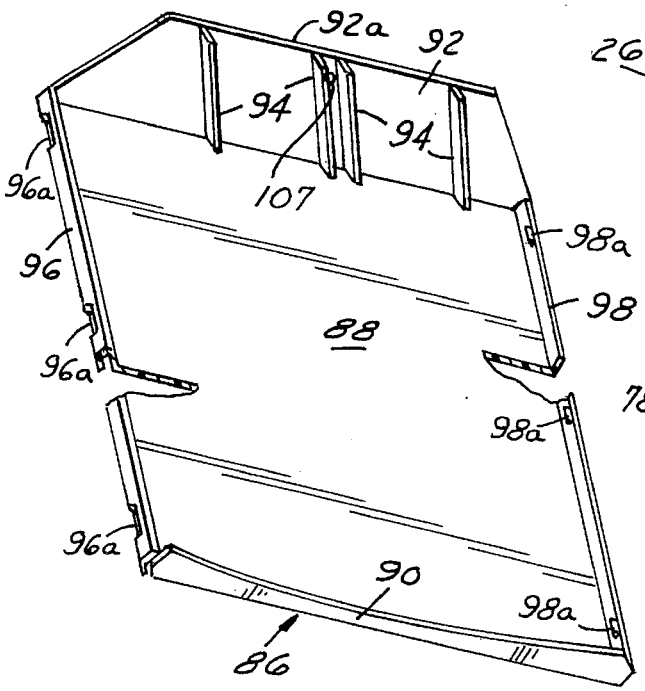
FIG. 8 is a perspective view of an individual liner panel partially broken away at each side to show the interconnection means.
Figure 7:
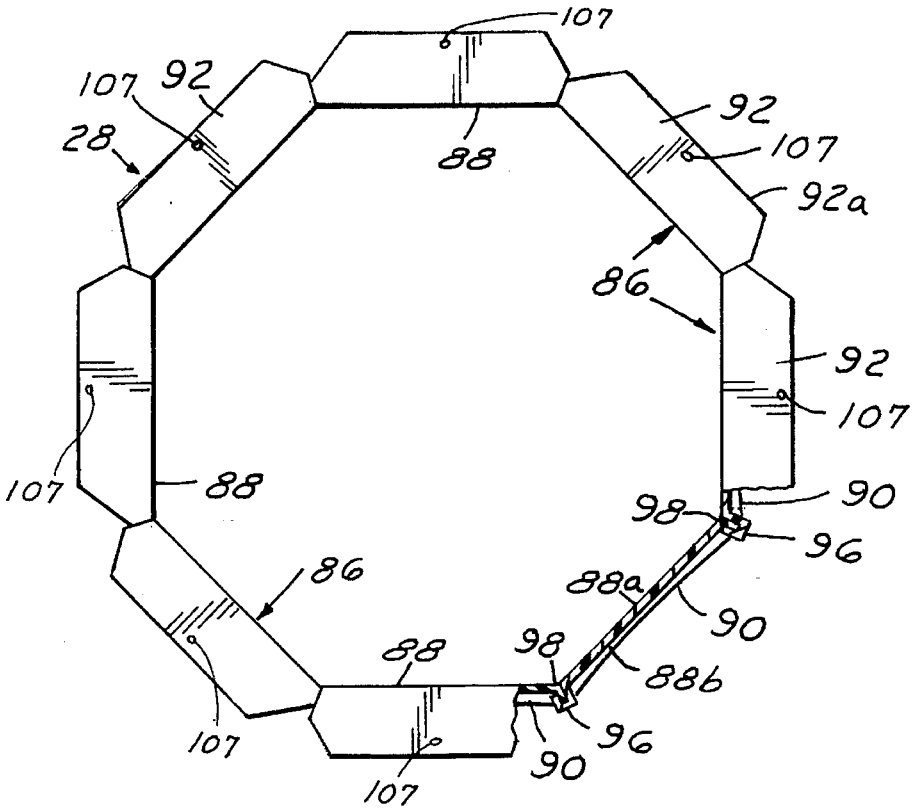
FIG. 7 is a back view of the assembled liner partially broken away to show the interconnection between the individual liner panels.
Figure 8A:
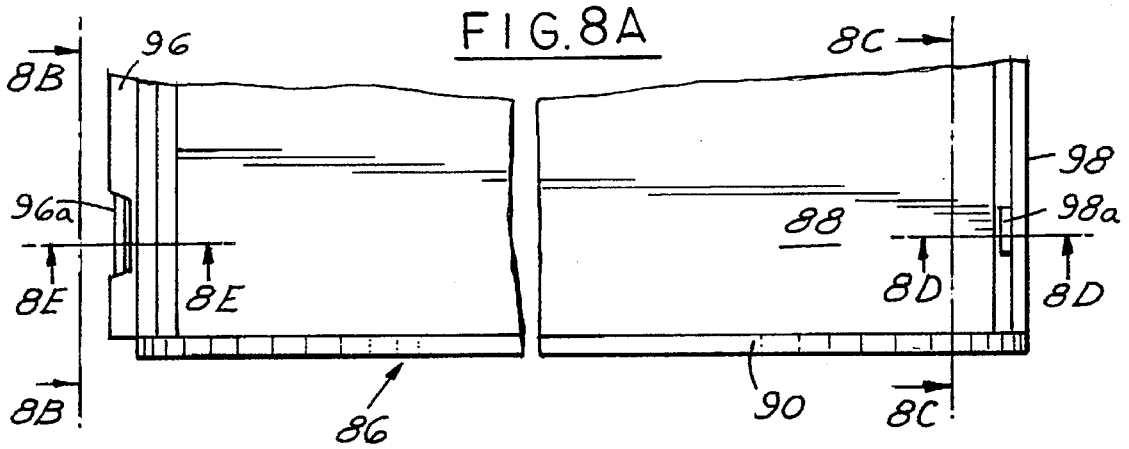
FIG. 8A is a partial plan view of the lower half of the liner panel of FIG. 8.
Figure 8B:
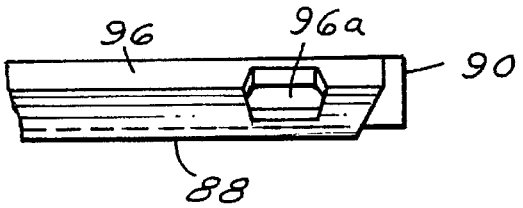
FIG. 8B is a view taken along line 8B—8B in FIG. 8A.
Figure 8C:
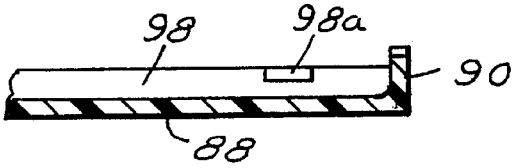
FIG. 8C is a view taken along line 8C—8C in FIG. 8A.

The liner assembly 28 (FIG. 7) comprises individual liner panels 86 (FIG. 8) interconnected to form an octagonal shape. Each liner panel 86 has a panel wall 88 having interior and exterior sides 88*a*,88*b*, a radial end wall 90 with a concave free edge at one end and a radial flange 92 at the opposite end. Axial ribs 94 are provided on the flange 92 to abut against the interior surface 21 of the wall or door 31 to maintain the free edge 92*a* of the radial flange 92 in spaced relation thereto. Each panel 86 has a side edge. One edge of end panel wall 88 is formed with a hook 96 extending axially therealong. As seen in FIGS. 8A–8C, the hook 96 extends inwardly and has a plurality of spaced openings 96*a* therein. The opposite edge of the panel wall 88 is formed with an outwardly extending extension wall 98 extending therealong in an exterior direction. The extension wall has a plurality of spaced teeth 98*a* for engagement with openings 96*a* in a hook 96 of an adjacent liner panel 86.

The interior trim ring 32, as seen in FIG. 6, has an outer radial wall 100 with a plurality of bead members 101 on an interior surface thereof and an inner radial wall 102. The inner peripheral edge of the liner assembly 28 is provided with a stepped portion 103, such that, when connected, an inner edge 104 of the inner radial wall 102 sits within the stepped portion 103.

Referring now to FIG. 7 and 8D–F, the liner assembly 28 is assembled by inserting the extension wall 98 of one liner panel 86 into the hook 96 of an adjacent liner panel. The teeth 98*a* of the extension wall 98 engage and snap into the openings 96*a* in the hook 96 to be permanently locked thereto. Once the liner panels 86 have been assembled, the plastic window assembly is ready for installation.

To install the plastic window assembly, a rough opening 30 is first cut from a wall or door 31 to the desired size corresponding to the size and shape of the plastic window assembly as seen in FIGS. 1 and 2. The outside assembly 20 is first installed where the window 24 is fastened to exterior surface 25 of the wall or door 31. The window 24 is mounted by flanges 60 on the housing 50 secured to the exterior surface 25 by fasteners such as nails. If the plastic window assembly is to be installed on a wall 31, siding (not shown) may be applied to the exterior surface 25 thereof. The siding generally covers the flange 60 and abuts the periphery of the window 24. The exterior trim ring 26 is adapted to be telescoped over the periphery of the window 24 to cover the abutting edges of the siding giving a finished appearance to the exterior of the building wall 31.

The interior assembly 22 is then installed within the rough opening 30 from the interior side 21 of the wall or door 31. The liner assembly 28 is inserted within rough opening 30 in the wall or door 31. It may be necessary to trim the length of the liner assembly 28 to accommodate the thickness of the wall or door 31. It is preferable that the liner assembly 28 extend beyond the exterior surface 25 of the wall or door 31 to properly engage the window 24. The end walls 90 of the liner panels 86 are then telescopically received within the window 24 between the outer wall 69 of the clamp ring 62 and the outer peripheral wall 46 of retainer 38 (FIG. 6). At the opposite end, the ribs 94 abut the interior surface 21 of the wall or door 31 to maintain the peripheral edge 92*a* of the liner assembly in spaced relation from the interior wall surface 21 for mounting of the interior trim ring 32. The interior trim ring 32 is then connected to the flanges 92 of the liner assembly 28. The outer edge 92*a* of the flange 92 engages behind the bead members 101 in a snap action to secure the interior trim ring 32 to the flanges 92 of the liner assembly 22. A plurality of self-tapping screws 105 extend through a single centrally located opening 107 in each flange 92. The interior trim ring 32 is then attached to the flanges 92.

The plastic window assembly may come in various colors to coordinate with various features of the building. If desire, the exposed surfaces may be painted or stained to simulate wood or molded in plastic of various colors, as desired.

It can thus be seen that there has been provided plastic window assembly of the present invention for an octagon window mounted within a rough opening in an exterior wall or door of a building. The plastic window assembly gives a finished appearance to both the interior and exterior of the wall or door and can be conveniently assembled without the use of fasteners. Additionally, the plastic window assembly can be readily modified to accommodate walls of different thickness and includes spaced window panels, one of which is glass and the other being plastic. Furthermore, the interior of the plastic window assembly can be readily painted.

Referring to FIGS. 20–23, there is shown a modified liner panel 88', corresponding parts being shown with a prime mark.

In this form each of the panels 88' is provided with indicia 120 delineating lines along which the panel should be cut to accommodate differing depth of walls into which the liner assembly is to be inserted.

Figure 23:
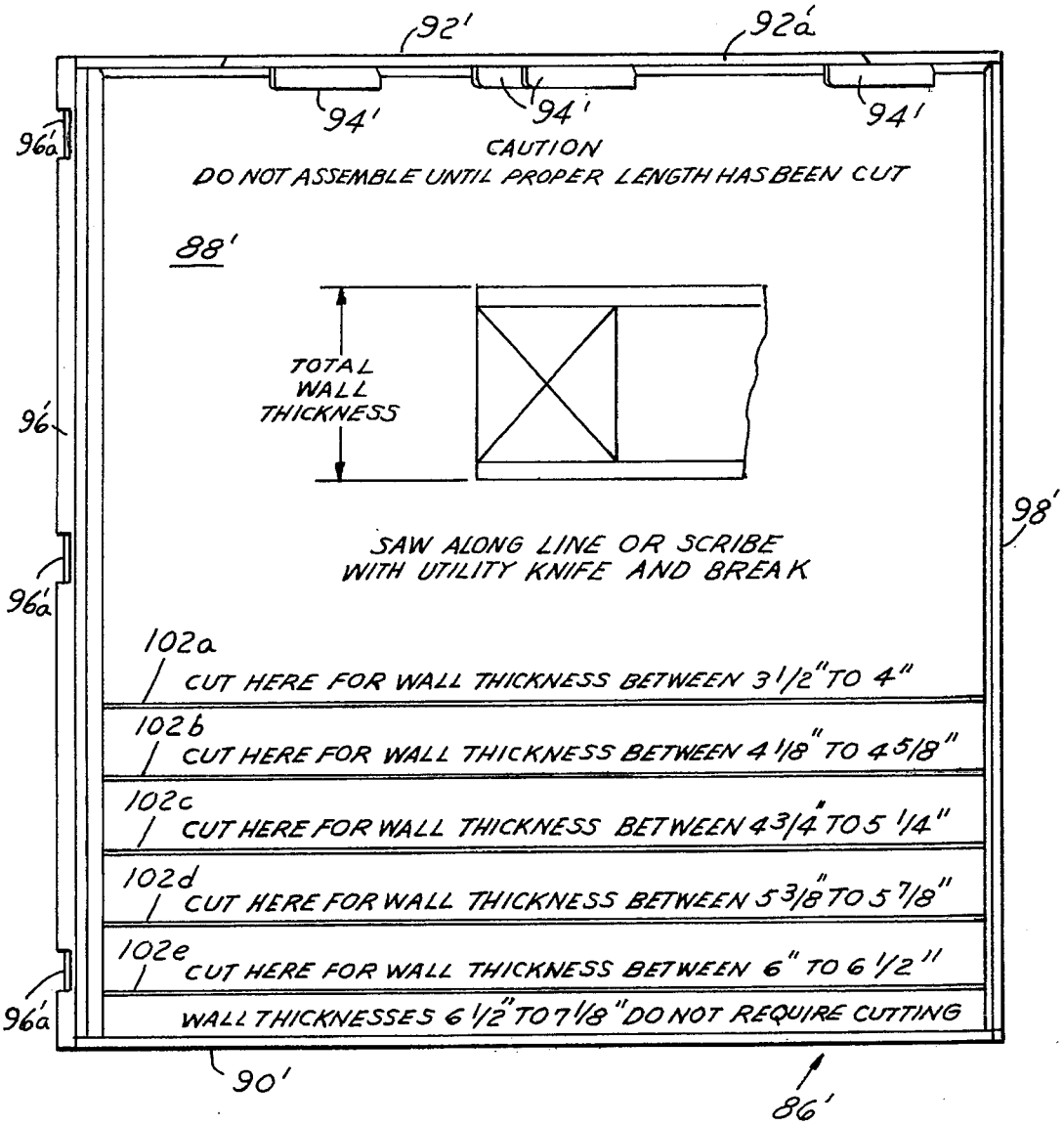
FIG. 23 is a top plan view.

As shown in FIG. 23, the indicia 120 preferably consists of integral raised lines 120 with secondary indicia in the form of wording associated with the lines indicating where the liner 88' should be cut with raises wording as follows:

indicia 120*a*—cut here for wall thickness between 3½" to 4"

indicia 120*b*—cut here for wall thickness between 4⅛" to 4⅝"

indicia 120*c*—cut here for wall thickness between 4¾" to 5¼"

indicia 120*d*—cut here for wall thickness between 5⅜" to 5⅞"

indicia 120*e*—cut here for wall thickness between 6" to 6½"

wall 90'—wall thickness 6½" to 7⅛" do not require cutting

I/We claim:

1. An octagonal window assembly adapted to be mounted in an opening in a wall or door of a building having an exterior surface and an interior surface comprising a window comprising a plastic frame and spaced window panels, said window being adapted to be mounted on the exterior side of the wall, an annular liner comprising a plurality of interconnected panels defining an annular array having opposed ends, one end being adapted to extend from the interior surface through the opening into engagement with the window and the opposite end being adapted to be positioned adjacent the interior surface of the wall, a plastic exterior annular trim ring on the window, and a plastic interior annular trim ring mounted on the opposite end of the liner, each said panel including indicia delineating a line along which the panel should be cut to accommodate wall openings having different thicknesses, said indicia including markings indicating ranges of wall thickness for each line.

2. The window assembly set forth in claim 1 wherein the window comprises a retainer, a clamp ring for securing said spaced window panels to the retainer, and interengaging means between said retainer and said clamp ring.

3. The window assembly set forth in claim 2 including interengaging means on a radial wall of the housing and said exterior trim ring for removably mounting said exterior trim ring thereto.

4. The window assembly set forth in claim 3 wherein said interengaging means comprises plural sets of teeth on one of said housing and said exterior trim ring, and a plurality of serrations on the other of said housing and said exterior trim ring.

5. The window assembly set forth in claim 4 wherein said plural sets of teeth are on said exterior trim ring and said plurality serrations are on said housing.

6. The window assembly set forth in claim 1 wherein each said panel of said liner is generally rectangular and includes opposed side edges having first and second interengaging means, respectively, wherein the first interengaging means on one side edge is secured to the second interconnecting means of an adjacent panel to form a polygonal liner.

7. The window assembly set forth in claim 6 wherein said interengaging means on said panels of said liner comprises an axially extending hook portion extending along one side edge, and an extension wall extending along the opposite side edge to engage said hook portion of an adjacent panel.

8. The window assembly set forth in claim 7 wherein said hook portion has a plurality of openings therein, and said extension wall has a plurality of teeth, such that when said extension wall of one said liner panel engages said hook portion of an adjacent liner panel, said teeth snap into the openings in the hook portion to lock the adjacent liner panels together.

9. The window assembly set forth in claim 1 wherein each said liner panel comprises a radial flange extending perpendicularly from the opposite end of said liner panel to define an inner peripheral edge of said liner panel, and interengaging means on each of said radial flange and said interior trim ring to mount the interior trim ring thereto.

10. The window assembly set forth in claim 9 wherein said interengaging means comprises a stepped portion at the inner peripheral edge of said liner for engaging an inner radial lip on said interior trim ring, and a plurality of bead means on a radial wall of said inner trim ring for engaging an outer edge of said flange in a snap action fit to retain said interior trim ring to the liner.

11. The window assembly set forth in claim 1 wherein said exterior trim ring, said window housing assembly, said liner, and said interior trim ring are made of plastic material.

12. The window assembly set forth in claim 1 wherein said window panels comprises two spaced apart window panes.

13. The window assembly set forth in claim 12 wherein one of said window panes is plastic and the other of said window panes is made of one of glass and plastic.

14. The window assembly set forth in claim 13 wherein said plastic window pane is formed to simulate leaded glass.

15. The window assembly in claim 13 wherein said glass window pane is clear.

16. The window assembly in claim 13 wherein said glass window pane is made of one of translucent and semi-translucent.

* * * * *